United States Patent [19]

Polman

[11] 4,389,434

[45] Jun. 21, 1983

[54] PERMEABLE GRASS-LIKE SPORT SURFACE WITH FUSED GLASS MEMBRANE

[75] Inventor: Herman A. Polman, Fijnaart, Netherlands

[73] Assignee: Chevron Research Company, San Francisco, Calif.

[21] Appl. No.: 348,385

[22] Filed: Feb. 12, 1982

[51] Int. Cl.[3] ..... E01C 7/00

[52] U.S. Cl. ..... 428/17; 428/95

[58] Field of Search ..... 428/17, 95

[56] References Cited

U.S. PATENT DOCUMENTS 3,332,828 7/1967 Faria et al. ..... 428/95 X 3,846,364 11/1974 Criddle et al. ..... 428/338 X 3,869,421 3/1975 Sapp et al. ..... 428/339 X

*Primary Examiner*—Marion McCamish

*Attorney, Agent, or Firm*—J. A. Buchanan, Jr.; D. A. Newell; T. G. De Jonghe

[57] ABSTRACT

A water-permeable, grass-like sport surface is provided. The sport surface comprises a solid, porous, resilient base mat and a thermoplastic, synthetic fiber, grass-like mat placed over the base mat. The grass-like mat is prepared by tufting synthetic fibers into a water-permeable fabric to obtain a fabric having loops of the synthetic fibers on the fabric's bottom side and a grass-like pile on its top side, then placing on the loops on the bottom side of the fabric a water-permeable, heat-resistant membrane, composed of high melting-point fibers or a mixture of high melting-point fibers, followed by heating the membrane to fuse the synthetic fibers to the membrane.

9 Claims, 3 Drawing Figures

PERMEABLE GRASS-LIKE SPORT SURFACE WITH FUSED GLASS MEMBRANE

BACKGROUND OF THE INVENTION

The present invention relates to a synthetic sport surface, particularly a water-permeable, resilient surface having a tufted, synthetic grass-like fiber pile.

U.S. Pat. No. 3,869,421 and U.S. Pat. No. 3,846,364 disclose resilient surfaces made, for example, with particles of rubber and a polyurethane binder, and other components. The '421 patent discloses a non-porous as well as a porous, resilient surface, and the '364 patent discloses a generally porous, resilient surface. Both references disclose, for example at column 5, line 26 of the '421 patent and column 5, line 25 of the '364 patent, that a grass-type carpet may be combined with the porous, resilient surface to obtain a playing field with the advantage of porosity and maintenance of a dry playing field. However, no method is given for obtaining a water-permeable, tufted, grass-type carpet.

Generally, tufted yarn-type carpets are obtained by tufting the fibers or yarn into a backing and then applying a latex or polyurethane to the backing to hold the tufts in place. Without the latex or polyurethane or the like, the tufts do not have stability and can relatively easily be dislodged from the fabric backing. The latex or polyurethane backing is not water permeable.

In the past, water-permeable playing surfaces have, however, been made by knitting (as opposed to tufting) the pile of the grass-like surface onto a backing and attaching a perforated, resilient, mat-like surface (for example, perforated foam rubber) to the backing of the knitted, grass-like surface. An adhesive is typically used to attach the rubber or foam mat to the grass-like surface, but the adhesive is not applied continuously on the backing as such would destroy the water permeability. In this regard, see for example, U.S. Pat. No. 3,332,828 entitled "Monofilament Ribbon Pile Product", at column 7, lines 54–56.

These knitted-type grass surfaces are not readily produced with heavy denier yarn.

Decorative carpet has been formed in the past by others by fusing or thermobonding tufted polypropylene to a membrane which membrane is formed, for example, from glass fibers.

SUMMARY OF THE INVENTION

According to the present invention, a water-permeable, grass-like sport surface is provided which sport surface comprises:

(a) a solid, porous, resilient base mat, formed from rubber or rubber-like particles bonded together by an adhesive;

(b) a thermoplastic, synthetic-fiber, grass-like mat placed over the base mat, said grass-like mat having been prepared by tufting the synthetic fibers into a fabric to obtain a fabric having loops of the synthetic fibers on the fabric's bottom side and a grass-like pile on its top side, placing on the loops on the bottom side of the fabric a water-permeable, heat-resistant membrane, composed of glass fibers or high melting-point fibers or a mixture of high melting-point fibers and glass fibers, followed by heating the membrane so as to fuse the synthetic fibers to the membrane; and (c) a discontinuous adhesive to attach the grass-like mat to the base mat.

Among other factors, the present invention is based on my finding that a sport surface prepared in accordance with the present invention has surprisingly high water permeability yet with good stability for holding the tufted yarn in place. Also, the surface may be relatively easily cared for by vacuuming to remove dust and dirt that might sift down in other surfaces and plug or obstruct the porosity to thus defeat the water permeability of such other sport surfaces over an extended period of time.

The thermoplastic, synthetic fibers used in the sport surface can be formed from various thermoplastic polymers, for example, acetal; acrylic; cellulosic; polyamide; such as the various Nylons: Nylon 6, Nylon 66, etc.; polyolefins such as polyethylene, polypropylene, polybutylene, etc.; polyvinyl chloride; etc. The thermoplastic, synthetic-fiber material for the grass-like top surface of the present sport surface must have a low enough melting point to melt so as to thermobond or fuse to the water-permeable, heat-resistant membrane. Preferably, the melting point of the thermoplastic, synthetic fibers is below about 250° C., more preferably below about 200° C.

Polypropylene is a particularly preferred material for use as the thermoplastic, synthetic fiber of the grass-like surface. Polypropylene has a melting point of about 168° C. for the homopolymer and about 160° to 168° C. for the copolymer polypropylene. For the polyallomer form of polypropylene available from Eastman, the melting point is about 120° to 135° C. The polypropylene or other themoplastic fibers can be obtained in various ways, including spinning to form fibers which fibers may subsequently be combined to form yarns, extruding to form ribbons, or extruding to form a film which is converted to a yarn by slitting the film, and then combining the strips by twisting into a yarn.

I have found that fibrillated polypropylene film can be used to provide a yarn which is very effective for making the grass-like portion of the sports surface of the present invention. The fibrillated polypropylene preferably is prepared by the method set forth in U.S. Pat. No. 3,496,259, or that of U.S. Pat. No. 3,496,260, the disclosures of which patents are incorporated herein by reference. After fibrillation of extruded polypropylene film and cutting the film into strips, the strips are twisted into yarns. The fibrillated strips preferably are 1 to 5 centimeters in width and 10 to 75 microns in thickness, more preferably 1.5 to 4 centimeters in width and 20 to 50 microns in thickness. The individual fibrils which make up the fibrillated film preferably are 0.5 to 10 mm in width, more preferably 0.5 to 2.5 mm in width.

The membrane to which the tufted, thermoplastic, synthetic fibers are bonded is formed of high melting-point fibers such as glass fibers. Other fibers which can be used are high melting-point polyester or thermoset polyester, high melting-point polyimides or thermoset polyimides, etc. For purposes of this specification, "high melting point" is used to include thermoset polymers or fibers that substantially retain dimensional stability at temperatures above the melting point of the themoplastic, synthetic fiber to be thermobonded to the membrane.

The heat-resistant membrane part of the sports system of the present invention can be formed from non-woven fibers or the fibers may be woven together. However, the membrane must be water permeable. Preferably the membrane will allow water to flow through at a rate of at least 60 liters per square meter per minute, more preferably at a rate of more than 200 liters per square meter per minute.

According to a particularly preferred embodiment of the present invention, the membrane permeability is sufficiently fine to retain most typical dust and dirt particles encountered on playing fields, such as that dust and dirt that may be brought onto the field from nearby earth areas. Thus, preferably the membrane is sufficiently fine to retain dust and dirt particles greater than 125 microns in diameter. The sports surface can be cleaned by a periodic vacuuming and is not as susceptible to losing its advantageous draining property as other sports surfaces where dust and dirt can sift down and obstruct or plug the pores of the base mat or the underlying surface which supports the base mat.

The sports surface of the present invention is typically laid by first placing the solid, porous, resilient base mat on a porous support surface, for example, an asphaltic surface, and then laying the grass-like surface over the base mat. The base mat is preferably 0.2 to 8.0 centimeters thick, more preferably 0.4 to 4.0 centimeters thick.

The grass-like surface is installed over the base mat. The grass-like mat preferably is 0.3 to 3 centimeters in pile height, more preferably 0.7 to 1.5 centimeters in pile height. Pile height is the height of the grass-like, thermoplastic, synthetic fibers above the fabric into which the fibers are tufted.

The grass-like mat is attached to the base mat by discontinuous adhesive. By "discontinuous adhesive" is meant an adhesive which is applied so as to allow the sports surface to be porous after the adhesive is applied. A continuous adhesive which forms a continuous, impermeable water-seal membrane between the grass-like mat and the base mat is not suitable. The adhesive may be made discontinuous by several methods, for example, by spot gluing, stripe gluing, etc. According to a preferred embodiment of the present invention, the discontinuous attachment of the grass-like mat to the base mat is obtained by using a solvent containing adhesive, such as neoprene, polyurethane, acrylic, etc., placed at intervals along the base mat to form a tacky surface and allowed to cure after the grass-like mat is placed over the base mat. The joints between two lanes of the grass-like surface will preferably be fixed with a heat-bond tape strip which will simultaneously close the joint, reinforce the joint and attach the grass-like material next to the joint to the base mat in order to make it less vulnerable to damage.

An important aspect of the invention is that the thermobonding or fusing of the synthetic, thermoplastic fibers to the membrane part of the glass-like mat is done so as not to form a continuous layer of melted, thermoplastic fiber. According to a preferred embodiment of the present invention, a sport surface is provided wherein the grass-like mat is prepared by:

(a) tufting thermoplastic yarn into a fabric backing in rows spaced no more than 0.5 centimeters apart, centerline to centerline, to form rows of loops on the bottom side of the fabric;

(b) placing on the loops, on the bottom side of the fabric, a water-permeable, heat-resistant membrane; and (c) controlled heating of the membrane to melt and fuse the loops to the membrane and fabric without melting sufficient of the yarn to flow to the next adjacent row of loops.

FURTHER DESCRIPTION AND EXAMPLES

Figure 1:
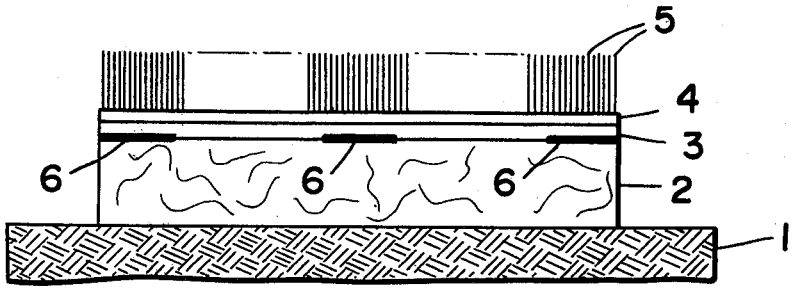
FIG. 1 is a schematic illustration of the sports surface on a supporting surface.

Referring now in more detail to FIG. 1, a support surface for the sports surface of the present invention is illustrated by layer 1. The support surface may be an asphaltic layer which is porous and will allow water to drain through it after it has drained through the sports surface.

The solid, porous, resilient base mat portion of the sports surface is illustrated by 2 in FIG. 1.

The grass-like mat portion of the sports surface is illustrated by the numerals 3, 4, and 5. That part of the grass-like mat illustrated by 3 is the heat-resistant membrane; that part illustrated by 4 is the fabric backing for the tufted, thermoplastic fibers; and that part illustrated by 5 is the tufted, thermoplastic fibers or yarn. The grass-like mat is attached to the solid, porous, resilient base mat using a discontinuous adhesive, preferably a solvent containing adhesive as illustrated at 6.

The solid, porous, resilient base mat indicated by 2 in FIG. 1 can be obtained as described, for example, in U.S. Pat. No. 3,846,364, the disclosure of which patent is incorporated herein by reference. The '364 patent describes a premix polyol to which is added an isocyanate and resilient aggregate such as rubber cuttings to thereby provide an overall mix which is castable into a resilient pavement. The polyol and isocyanate forms a polyurethane, which acts as a binder as well as having resilience.

Alternatively, the castable mix can be provided by forming a moisture curing prepolymer containing isocyanate groups, to which moisture curing prepolymer is added resilient aggregate and a catalyst for the catalysis of the moisture curing reaction. Then the combined mixture is cast to form the base mat under humidity conditions sufficient to supply the moisture to effect the curing. Suitable catalysts for the curing reaction include organic lead compounds, organic tin compounds, organic mercury compounds, amines, etc.

When the prepolymer reacts with water, a diamine is formed and carbon dioxide is released. The diamine reacts with more prepolymer to form the cured polymer bonds which serves as a binder to hold the resilient, aggregate pieces together in the cured cast surface such as schematically illustrated by 2 in FIG. 1. Also, the binder itself is resilient. Various other materials may be used as binders provided they bind the resilient aggregate together, are resilient, and form a porous structure in binding the aggregate.

The moisture curing reaction for the prepolymer containing isocyanate groups is illustrated, for example, as follows:

Primary Reaction $$\mathrm{HOH} + \underbrace{\mathrm{O{=}C{=}N{-}R{-}NCO}}_{\text{prepolymer}} + \mathrm{HOH} \xrightarrow{\text{catalyst}}$$

-continued $$2\,CO_2\uparrow + \underset{\text{diamine}}{H_2N-R-NH_2}$$

Secondary Reaction $$\frac{n+2}{2}\,\underset{\text{diamine}}{H_2N-R-NH_2} + \frac{n+2}{2}\,\underset{\text{prepolymer}}{O=C=N-R-N=C=O} \longrightarrow$$

$$H_2N-R-\underset{\underset{H}{|}}{N}-\left[\underset{\underset{O}{\|}}{C}-\underset{\underset{H}{|}}{N}-R-\underset{\underset{H}{|}}{N}-\underset{\underset{O}{\|}}{C}-\underset{\underset{H}{|}}{N}-R-NCO\right]_n$$

large molecule (cured product)

Preferred resilient aggregate includes pieces or particles of rubber, either natural or synthetic rubber, polyurethane granules, etc. The rubber can be buffings or grindings from waste tires. The size of the particles preferably is 0.5 to 10 mm in diameter, more preferably 1 to 4 mm in diameter. The length to diameter ratio is preferably less than 10 and more preferably less than about 3.

Figure 2:
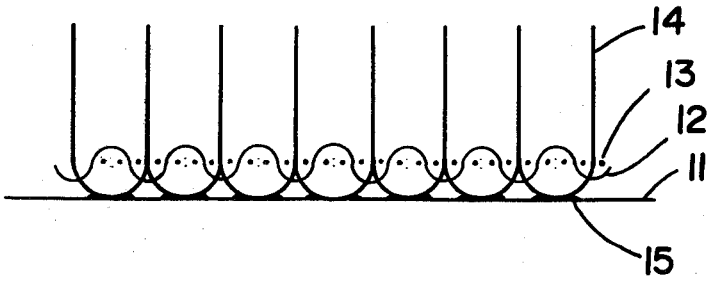
FIG. 2 is a schematic illustration of the grass-like mat of the sports surface including the membrane portion of the grass-like mat.

FIG. 2 is a greatly enlarged schematic illustration of the grass-like mat portion of the sports surface of the present invention. The tufts of synthetic, thermoplastic fibers or yarn are illustrated by 14. One row of tufts is shown by the seven tufts in FIG. 2. In the sport surface of the present invention, a row of tufts is preferably 0.2 to 0.5 centimeters apart, centerline to centerline, more preferably 0.3 to 0.4 centimeters apart.

The fabric backing into which the thermoplastic, synthetic fibers or yarn is tufted is illustrated by 12 and 13 in FIG. 2. This backing may be formed by weaving various different fibers, including using polypropylene yarn or fibers to form the backing. The fabric backing shall have warp and filling dense enough to avoid destruction by the needles during the tufting process. For this reason, twill-type weave is preferred with a filling of at least 500 threads per meter.

The heat-resistant membrane part of the grass-like mat is illustrated by 11 in FIG. 2.

The membrane can be formed from continuous filament fibers or yarns, from rovings, from chopped fibers or from a mixture of the foregoing. It may be a combination of fibers such as polyester and glass fibers; carbon fibers; aramid fibers such as DuPont Kevlar aramid fiber; aramid and glass fibers; carbon and glass and aramid fibers; carbon and glass fibers; etc.

The membrane may be prepared by matting together, that is by matting together non-woven fibers using known techniques for forming non-woven fabrics or membranes. It may alternatively be prepared by weaving continuous fibers. However, it must be water permeable, as previously stated. The water should be able to flow through at a rate of at least 60 liters per square meter per minute, preferably at a rate of more than 200 liters per square meter per minute.

At 15 in FIG. 2, the thermoplastic yarn tufts contact the membrane; the yarn is shown somewhat thicker at this point to represent the result of heating at or near the membrane and consequent melting and thermobonding of the thermoplastic yarn tufts to the membrane.

Figure 3:
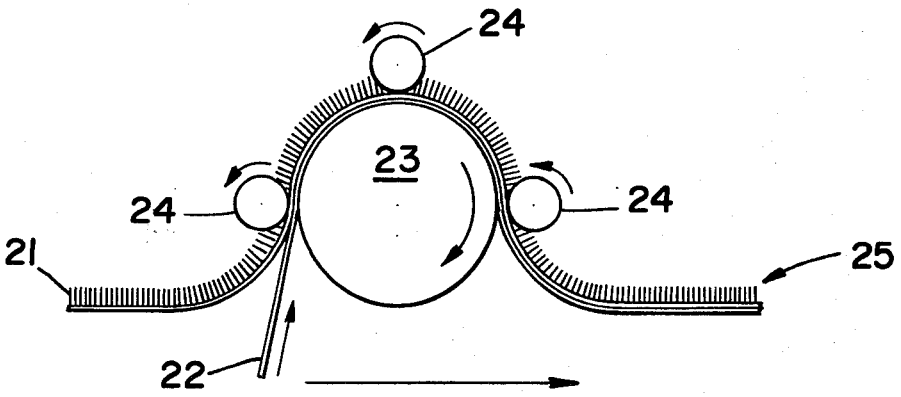
FIG. 3 is a schematic illustration of the grass-like mat being thermobonded to the heat-resistant membrane.

FIG. 3 is a schematic illustration of thermobonding the membrane to the thermoplastic, synthetic fibers or yarn. The thermoplastic, synthetic fibers tufted into a fabric backing are illustrated by 21 in FIG. 3. The heat-resistant membrane is illustrated by 22 in FIG. 3. As shown, these two components are advanced over heating means 23 using rollers as illustrated by 24. The temperature of the heated large roller 23 and the speed with which the parts 21 and 22 are advanced, is controlled so as to achieve the desired amount of fusion or thermobonding of the thermoplastic, synthetic fibers to membrane 22. The fusion is attained by locally melting the thermoplastic, synthetic fibers at the loops of the tufts, which melted material attaches to the membrane upon cooling and solidifying. For fusing, a tufted yarn composed of fibrillated polypropylene to a membrane composed of glass fibers and polyester fibers, the temperature for heated roll 23 preferably is between 170° and 250° C., more preferably between 170° and 200° C., and the length of time for passage of parts 21 and 22 over heated roller 23, preferably is between 2 and 30 seconds. The thermobonded product is shown coming off the rollers at 25.

EXAMPLES

Example 1

A grass-like surface was obtained by tufting fibrillated polypropylene yarn into a polypropylene fabric. The yarn, identified as Polyloom II yarn, was supplied by Chevron Fibers, Inc. The fabric, identified as TP 2413, was supplied by T.T.C. Polyolefins, Nijverdal, The Netherlands. The tufting density was 32 rows per 10 centimeters and 43 stitches per 10 centimeters. A pile height of about 12 millimeters was maintained. To the underside of this grass-like surface, a polyester membrane was thermally bonded. The membrane, identified as Lutradur 7250, was supplied by Freudenberg, Kaiserslautern, West Germany. The water permeability of the sample was tested using the method described on page 258 of *Sportstaettenbau und Baederanlagen,* 1980, 4. Water permeability found on this system is listed in Table 1. A much higher permeability was obtained than originally expected even though about 70 percent of the membrane surface became impermeable by too much melting of the yarn. The thermal bonding resulted in an excellent bonding strength as shown by the tuft pull-out force.

EXAMPLE 2

A grass-like surface was obtained similar to Example 1. In this case, the polyester membrane was reinforced with a glass fiber netting to give higher strength and better dimensional stability. The glass fiber netting, identified as Silicone Turbo Tissue, TRG 2×2, was supplied by S. T. F. Chavanoz, Pont du Cherry, France. Thermobonding was done at somewhat lower temperature than in Example 1, resulting in lower coverage of the membrane by melted yarn. The favorable effect on water permeability shows that melting of the yarn should be limited such that the area left uncovered by melted yarn preferably is more than 50 percent of the membrane surface.

EXAMPLE 3

A grass-like surface was obtained similar to Example 2. Instead of a polyester membrane, a glass fiber membrane was used. The membrane, identified as SH 45/5, was supplied by Glasswerk Schuller, Wertheim, West Germany. Water permeability was equal to that in Example 2. It was found that the adhesion of this membrane to a solvent based neoprene adhesive and a heat-bond tape was superior to that of the membrane used in Examples 1 and 2.

EXAMPLE 4

A grass-like surface was obtained similar to Example 1. Instead of a tufting density of 32 rows per 10 centimeters, 25 rows per 10 centimeters were used and the pile height was maintained at about 10 millimeters instead of 12. For better strength, two layers of primary polypropylene backing were used on top of each other. The negative effect thereof on water permeability was noted.

EXAMPLE 5

A grass-like surface was obtained similar to Example 4. Instead of a thermally bonded membrane, a polyurethane foam layer was bonded with a polyurethane adhesive to the underside of the grass-like surface. To make the system water permeable, holes of 4 millimeter diameter were drilled in the system at intervals of 5 centimeters. Water permeability of such a system appeared to be relatively low.

EXAMPLE 6

A porous, resilient base mat was prepared by mixing 100 parts rubber particles, 20 parts of a polyurethane prepolymer and 0.035 parts of an amine/lead catalyst. The rubber particles were 1 to 4 millimeters in size and supplied by Krause Gummi Granulate, Dortmund, West Germany. The polyurethane prepolymer had an NCO content of 10 mass percent and a viscosity of 1900 CP at 25° C. and was identified as Elastan 8000, supplied by E.P.U., Geiselbullach, West Germany. The base mat was leveled and allowed to cure for 48 hours. The water permeability was measured and found to be lower than the grass-like surfaces prepared as Examples 2, 3 and 4. Therefore, the base mat will be the part determining water permeability of the final system.

EXAMPLE 7

A grass-like surface was obtained similar to Example 3. Instead of a tufting density of 32 rows, 25 rows per 10 centimeters were used and the pile height was maintained at about 10 millimeters instead of 12. This grass-like surface was glued to a base mat obtained as described in Example 6. An adhesive was applied in a discontinuous fashion, covering about 16 percent of the area. Water permeability appeared to be about equal to the base mat alone.

Table 1 below summarizes data from the foregoing examples.

The denier of the polypropylene yarn used to obtain the grass-like surface in the foregoing examples was 5700. Other deniers can be used, for example 2000 to 10,000 denier. Preferred denier is 4000 to 8000. At the higher deniers a lower number of stitches per centimeter is used.

TABLE 1

| Example | Rows per 10 cm | Pile Height, mm | Type of Membrane | Surface of Membrane Covered by Melted Yarn, percent | Water Permeability, Liter per $m^2$ per minute | Tuft Pull-out Force, Newton |
|---|---|---|---|---|---|---|
| 1 | 32 | 12 | PE | 70 | 54 | 22 |
| 2 | 32 | 12 | PE + Glass | 50 | 150 | 20 |
| 3 | 32 | 12 | Glass + Glass | 50 | 138 | 10 |
| 4 | 25 | 10 | PE | 30 | 102 | 17 |
| 5 | 25 | 10 | — | — | 54 | 22 |
| 6 | — | — | — | — | 60 | — |
| 7 | 25 | 10 | Glass + Glass | 30 | 54 | 10 |

I claim:

1. A water-permeable, grass-like sport surface comprising:

(a) a solid, porous, resilient base mat, formed from rubber or rubber-like particles bonded together by binder;

(b) a thermoplastic, synthetic fiber, grass-like mat placed over the base mat, said grass-like mat having been prepared by tufting the synthetic fibers into a fabric to obtain a fabric having loops of the synthetic fibers on the fabric's bottom side and a grass-like pile on its top side, placing on the loops on the bottom side of the fabric a water-permeable, heat-resistant membrane, composed of glass fibers or high melting-point fibers or a mixture of high melting-point fibers and glass fibers, followed by heating the membrane to thereby fuse the synthetic fibers to the membrane; and (c) a discontinuous adhesive to attach the grass-like mat to the base mat.

2. A sport surface in accordance with claim 1 wherein the base mat is 0.4 to 4.0 centimeters in thickness and the grass-like mat has a pile height of 0.3 to 3.0 centimeters.

3. A sport surface in accordance with claim 1 wherein the thermoplastic, synthetic fiber is polypropylene.

4. A sport surface in accordance with claim 3 wherein the polypropylene is in the form of a yarn prepared by twisting a fibrillated strip of polypropylene film.

5. A sport surface in accordance with claim 4 wherein the yarn is formed from fibrillated strips of 1 to 5 centimeters in width and 10 to 75 microns in thickness.

6. A sport surface in accordance with claim 5 wherein the fibrils of the fibrillated strip are 0.5 to 10 millimeters in width.

7. A sport surface in accordance with claim 4 wherein the grass-like mat is prepared by:

(a) tufting the yarn into the fabric in rows spaced no more than 0.5 centimeters apart to form rows of loops on the bottom side of the fabric;

(b) placing on the loops, on the bottom side of the fabric, a water-permeable, heat-resistant membrane; and (c) controlled heating of the membrane to melt and fuse the loops to the membrane and fabric without melting sufficient of the yarn to flow to the next adjacent row of loops.

8. A sport surface in accordance with claim 1 wherein the permeability of the membrane is sufficiently fine to retain on its surface dust and dirt particles greater than 125 microns in diameter.

9. A water-permeable, grass-like sport surface comprising:

(a) a solid, porous, resilient base mat of rubber or rubber-like particles bonded together by a binder;

(b) a fabric for receiving loops of synthetic fibers;

(c) grass-like loops of synthetic fibers tufted into the fabric to provide a grass-like pile on a top side and loops on a bottom side of the fabric;

(d) a water-permeable, heat-resistant membrane composed of glass fibers or high melting-point fibers or a mixture of high melting-point fibers and glass fibers, said membrane located between the fabric and the base mat and bonded to the fabric and grass-like loops of synthetic fibers by fusion of melted loops at the bottom side of the fabric; and (e) a discontinuous adhesive attaching the membrane to the base mat.

* * * * *